US011802751B2

(12) United States Patent
Sun et al.

(10) Patent No.: US 11,802,751 B2
(45) Date of Patent: Oct. 31, 2023

(54) REFLECTIVE INNER RED DOT SIGHT OPTICAL SYSTEM WITH IMPROVED MONOCHROMATICITY AND CONCEALMENT, TWO-LIGHT THREE-COLOR OPTICAL SYSTEM, AND SIGHT THEREOF

(71) Applicant: Huanic Corporation, Shaanxi (CN)

(72) Inventors: Jianhua Sun, Shaanxi (CN); Yingzi Yang, Shaanxi (CN); Dong Wang, Shaanxi (CN)

(73) Assignee: Huanic Corporation, Shaanxi (CN)

( * ) Notice: Subject to any disclaimer, the term of this patent is extended or adjusted under 35 U.S.C. 154(b) by 35 days.

(21) Appl. No.: 17/418,670

(22) PCT Filed: Dec. 31, 2019

(86) PCT No.: PCT/CN2019/130414
§ 371 (c)(1),
(2) Date: Jun. 25, 2021

(87) PCT Pub. No.: WO2020/143504
PCT Pub. Date: Jul. 16, 2020

(65) Prior Publication Data

US 2022/0074704 A1 Mar. 10, 2022

(30) Foreign Application Priority Data

Jan. 12, 2019 (CN) ..... 201910028904.8

(51) Int. Cl.
*F41G 1/30* (2006.01)

(52) U.S. Cl.
CPC ..... *F41G 1/30* (2013.01)

(58) Field of Classification Search
CPC ..... F41G 1/30
(Continued)

(56) References Cited

U.S. PATENT DOCUMENTS

2008/0032268 A1* 2/2008 Farrell ..... F41A 33/00 42/70.01
2009/0168057 A1* 7/2009 Gerlach ..... F41G 1/30 356/251
(Continued)

FOREIGN PATENT DOCUMENTS

CN 204806974 U 11/2015
CN 105980808 A 9/2016
(Continued)

OTHER PUBLICATIONS

International Search Report dated Apr. 14, 2020 in connection with International Application No. PCT/CN2019/130414.
(Continued)

*Primary Examiner* — Samir Abdosh

(57) ABSTRACT

A reflective inner red dot sight optical system with improved monochromaticity and concealment, a two-light three-color optical system, and a sight thereof. The reflective inner red dot sight optical system comprises an LED chip and a lens for reflecting light emitted from the LED chip. A filter provided with a narrow-band interference filter coating is provided near the LED chip and located between the LED chip and the lens. The filter is used to filter out wide band waves not in the central wavelength of the light reflected from the lens into the eye, thereby improving the monochromaticity of the light entering the eye.

8 Claims, 9 Drawing Sheets

(58) Field of Classification Search
USPC ..... 42/113
See application file for complete search history.

(56) References Cited

U.S. PATENT DOCUMENTS

| | | | |
|---|---|---|---|
| 2011/0228366 | A1 | 9/2011 | Liu |
| 2012/0110887 | A1 | 5/2012 | Reimer |

FOREIGN PATENT DOCUMENTS

| | | | |
|---|---|---|---|
| CN | 106197147 | A | 12/2016 |
| CN | 108873135 | A | 11/2018 |
| CN | 209926991 | U | 1/2020 |
| FR | 2443695 | B1 | 2/1986 |
| JP | 2005-005217 | A | 1/2005 |
| JP | 2007-093609 | A | 4/2007 |
| JP | 2007-187397 | A | 7/2007 |
| JP | 2013-252413 | A | 12/2013 |
| JP | 2016-218303 | A | 12/2016 |
| JP | 2017-508946 | A | 3/2017 |
| JP | 2018-180031 | A | 11/2018 |
| KR | 10-1770772 | B1 | 8/2017 |
| WO | 2010/039928 | A2 | 4/2010 |
| WO | WO 2011/004709 | A1 | 1/2011 |
| WO | WO 2011/123035 | A1 | 10/2011 |

OTHER PUBLICATIONS

Japanese Office Action dated Jul. 19, 2022, in connection with Japanese Application No. 2021-540414.

Extended European Search Report dated Aug. 1, 2022, in connection with European Application No. 19908320.5.

Japanese Office Action dated Jan. 10, 2023, in connection with Japanese Application No. 2021-540414.

Japanese Office Action dated Aug. 15, 2023, in connection with Japanese Application No. 2022-194122.

* cited by examiner

REFLECTIVE INNER RED DOT SIGHT OPTICAL SYSTEM WITH IMPROVED MONOCHROMATICITY AND CONCEALMENT, TWO-LIGHT THREE-COLOR OPTICAL SYSTEM, AND SIGHT THEREOF

RELATED APPLICATIONS

This Application is a national stage filing under 35 U.S.C. 371 of International Patent Application Serial No. PCT/CN2019/130414, filed Dec. 31, 2019, entitled "REFLECTIVE INNER RED DOT SIGHT OPTICAL SYSTEM WITH IMPROVED MONOCHROMATICITY AND CONCEALMENT, TWO-LIGHT THREE-COLOR OPTICAL SYSTEM, AND SIGHT THEREOF". Foreign priority benefits are claimed under 35 U.S.C. § 119(a)-(d) of Chinese application number 201910028904.8, filed Jan. 12, 2019. The entire contents of these applications are incorporated herein by reference in their entirety.

TECHNICAL FIELD

The present disclosure relates to a reflective inner red dot sight optical system with improved monochromaticity and concealment, two-light three-color optical system, and a sight thereof.

BACKGROUND

The light emitted by the LED chip installed on the existing gun sight is reflected by the cemented lens to form an aiming spot, the light-emitting wave band of the LED chip is 560±80 nm or other wavebands, and the light emitted from the LED often contains red, yellow, green and other colors, this multi-color light is reflected by the narrow-band interference filter film and the long-wavelength cutoff filter film plated on the cemented lens, the light with a wavelength of 545±15 nm and greater than 600 nm is reflected into the human eye, when the human eye observes the sight, there will be multiple target images with overlapping colors (multi-wavelength light projecting target images of different colors), which affects the clarity of the target, causes aiming errors, and reduces shooting accuracy. At the same time, looking at the cemented lens from a long distance, the band energy emitted by the LED chip is very strong, which is easy to be detected by human, exposes the target, and reduces the concealment of the sight.

The existing inner red dot sights have single light, two-light or three-light (multiple-light), however, the realization of the three-color function requires a corresponding number of LED chips or light-emitting units or light-emitting modules, which results in high power consumption, unswitchable graphics, complex installation structure, high debugging and maintenance costs, and the size of the sight will also increase. As a result, the carrying weight and volume have increased to varying degrees, making it inportability.

SUMMARY

The first purpose of the present disclosure is to overcome the problem that there are two or more colors of target images reflected by the lens or lens group or cemented lens into the human eye because the existing sighting device has a wide light-emitting band of the LED chip, and the problem that the light emitted from the lens or the lens group or the cemented lens is too strong, leading to reduced concealment.

The second purpose is to overcome the problems of complex structure, large weight and volume of the existing multi-beam sights and the cost is high and inportability.

To achieve the above purposes, the present disclosure provides a reflective inner red dot sight optical system with improved monochromaticity and concealment, the optical system includes an LED chip and a lens for reflecting light emitted from the LED chip, a filter plated with a narrow-band interference filter film is provided near the LED chip and located between the LED chip and the lens; the filter (2) is used to filter out light of a wider waveband except the center wavelength emitted from the LED chip (1), which improves a monochromaticity of light waves entering a human eye, a light energy of the light except the center wavelength emitted from the filter (2) is weakened or cut off, a light energy of the center wavelength emitted from the filter (2) shines on a cemented reflective surface of the lens (3), the cemented reflective surface is plated with a cutoff film that cuts off the center wavelength, looking at the lens (3) from a long distance, the light emitted from the lens (3) is not easy to be found, which improves the concealment of the sight.

In order to overcome the problems of complex structure, large weight and volume of the existing multi-light sights and the cost is high and inportability, the present disclosure provides a two-light three-color optical system which includes a green light chip module, a red light chip module and a right-angle prism.

The green light chip module and the red light chip module are arranged perpendicular to each other.

The geometric center of the right-angle prism is set at an intersection of the light emitted from the green light chip module and the red light chip module.

The diagonal surface of the right-angle prism extends along the angle bisector of the angle between the light emitted from green light chip module and the red light chip module, and the side of the diagonal surface facing the red light chip module is plated with a red light total reflection film, the side of the diagonal surface facing the green chip module is plated with a green light transmission film.

The cube prism is glued together by two isosceles right-angle prisms, and the diagonal surface is a cemented surface, one side of the cemented surface is plated with the red light total reflection film; after being totally reflected by the cemented surface, the green light transmission film is plated along the other surface of the cemented surface.

A sight including the above described two-light three-color optical system includes an LED mounting base installed at the back of a body, the green light chip module is installed on a front end surface of the LED mounting base, and the red light chip module is installed on a front end side of the LED mounting base through an LED base; an installation plane of the LED base is perpendicular to the front end surface of the LED mounting base.

A two-light three-color optical system includes a green light chip module, a red light chip module, a cube prism and a cemented lens.

The green light chip module and the red light chip module are arranged perpendicular to each other.

The geometric center of the cube prism is arranged at an intersection of the light emitted from the green light chip module and the red light chip module.

The cemented lens is arranged on the exit light path of the cubic prism.

The cemented lens is composed of a positive lens and a negative lens, the positive lens and the negative lens are arranged in the order of distance from the cube prism from far to near; the negative lens is plated with a narrow-band interference filter film with a center wavelength of 545±15 nm and a long-wavelength cutoff filter film with a wavelength greater than 600 nm.

The diagonal surface of the cube prism extending along an angle bisector of an angle between the light emitted from green light chip module and the red light chip module is plated with a composite film, the composite film is used to totally reflect an emitted red light of the red light chip module and transmit an emitted green light of the green light chip module.

The cube prism is formed by gluing two isosceles right-angle prisms, the diagonal surface is a cemented surface; the surface A, surface B, and surface C of the cube prism are all plated with an anti-reflection film with different wavelength of the light.

The surface A is two adjacent surfaces that are perpendicular to each other, and are respectively light incident surfaces of the green light chip module and the red light chip module.

The surface B is a light exit surface after the light emitted by the green light chip module and the red light chip module passes through the diagonal surface.

A sight including the two-light three-color optical system includes an LED mounting base installed at the back of a body, the green light chip module is installed on a front end surface of the LED mounting base, and the red light chip module is installed on a front end side of the LED mounting base through an LED base; the installation plane of the LED base is perpendicular to the front end surface of the LED mounting base.

The advantages of the present disclosure are as follows: the monochromaticity of the light emitted by the LED chip that enters the human eye is improved, the light energy emitted from the lens is reduced, and is not easy to be found, and the concealment of the sight is improved; By setting two red and green light sources that emit light perpendicular to each other, with the help of a prism and a total reflection film or a transmission film, the generation of green light, red light or yellow light can be realized by controlling the circuit, which greatly reduces the number of light sources and the volume and weight of the sight. By setting two red and green light sources that emit light perpendicular to each other, with the help of a prism and a total reflection film or a transmission film, the generation of green light, red light or yellow light can be realized through the control circuit, which greatly reduces the number of light sources and the volume and weight of the sight.

The present disclosure will be described in detail below in conjunction with the drawings and embodiments.

Explanation of reference symbols of accompanying drawings are as follows: 1. LED chip; 2. filter; 3. lens; 4. green light chip module; 5. red light chip module; 6. cube prism; 7. LED mounting base; 8. diagonal face; 9. LED base; 10. slider; 11. body; 12. 13. light source; 14. cemented lens.

DETAILED DESCRIPTION

In order to overcome the problem that there are two or more colors of target images reflected by the lens or lens group or cemented lens into the human eye because the existing sighting device has a wide light-emitting band of the LED chip, and the problem that the light emitted from the lens or the lens group or the cemented lens is too strong, leading to reduced concealment. Specifically, in the past, light was only filtered through the reflective film of the lens, but this filtering method has a problem that the efficiency of entering the human eye after external light passes through the lens is reduced, on the one hand, if the high efficiency of human eyes observing the external light is ensured, it will result in part of the light energy filtered out of the LED will be unclean; on the other hand, if it can ben filtered out, the light passing part will lose color more seriously (the human eye will look blue or red when observing the outside through the lens), and the light passing efficiency will decrease, which will affect the human eye's observation of the outside world.

Figure 1:
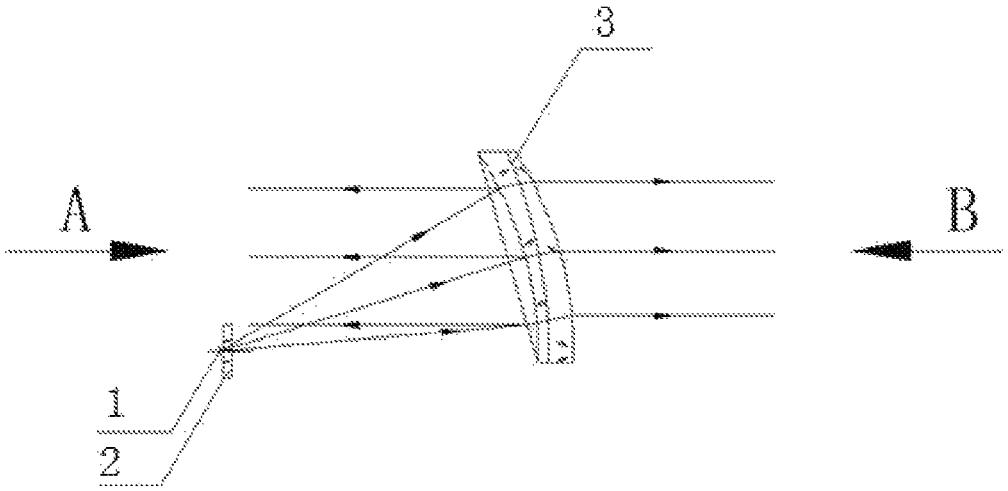
FIG. 1 is a schematic diagram of an optical system with filters.

This embodiment provides a reflective inner red dot sight optical system shown in FIG. 1 that can improve monochromaticity and concealment, which includes an LED chip 1 and a lens 3 for reflecting the light emitted from the LED chip 1 (LED light-emitting chip), a filter 2 plated with a narrow-band interference filter film is provided near the LED chip 1 and located between the LED chip 1 and the lens 3; the narrow-band filter 2 is used to filter out the light of the wider waveband except the center wavelength emitted by the LED chip 1, which improves the monochromaticity of the light waves entering the human eye and weaken the light energy emitted from the lens 3, thereby effectively avoiding being discovered and improving concealment, at the same time, the lens 3 only needs to be plated with a cutoff film for the light passing through the filter 2, so that the cutoff range of the light spectrum that enters the human eye through the lens 3 is small, and there is no obvious color loss, which improves the efficiency of the incident light, and the human eye observation is more comfortable.

The closer the filter is disposed to the LED chip, the greater the light-emitting angle of the light entering the filter, the more wavebands are filtered out, and the narrower the wavebands entering the cemented lens (lens), from the A direction, the human eye sees the light emitted from the LED light-emitting chip is in a narrower band. In this embodiment, the distance between the LED chip 1 and the filter 2 is preferably in the range of 0 to 4 mm, the closer the filter 2 is to the LED light-emitting chip, the better the effect, such as 2 mm, 1.5 mm, 1 mm, or 0.5 mm or 0.2 mm, and even adhere to the surface of the LED chip by optical bonding.

The principle and effect of adding the filter 2 can be described in detail with reference to FIGS. 2 to 6 in order to understand the design concept and technical solution of this embodiment.

Figure 2:
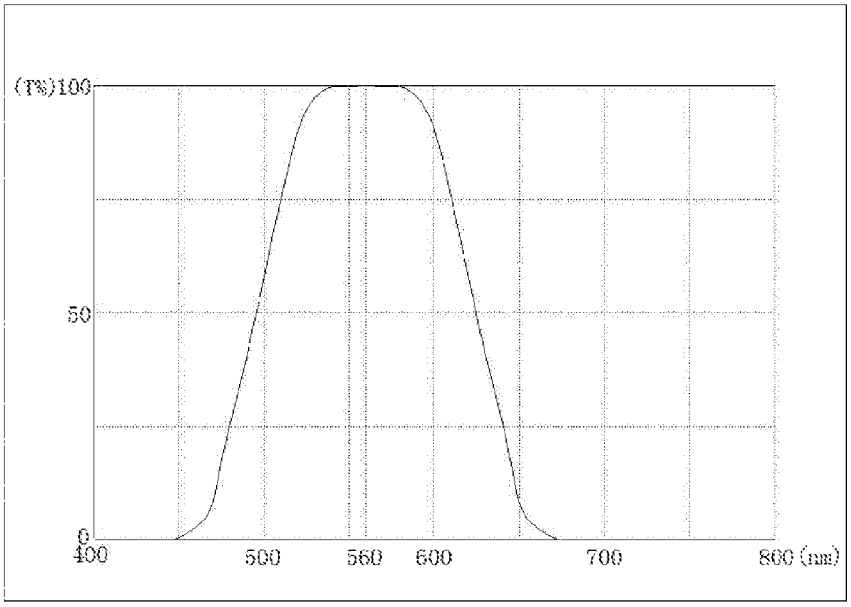
FIG. 2 is a graph of the wavelength of the light emitted by the LED chip at a wavelength of 560±80 nm.
Figure 3:
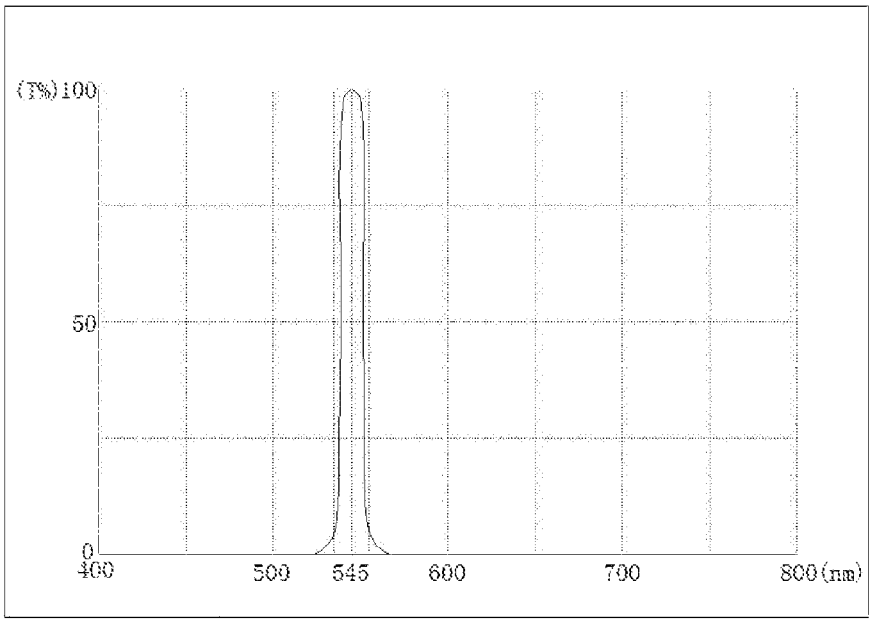
FIG. 3 is a graph of the wavelength when the narrow-band interference filter film is plated on the filter, and the light wavelength band that can be transmitted is 545±8 nm, and the other wavelength bands cannot be transmitted.
Figure 4:
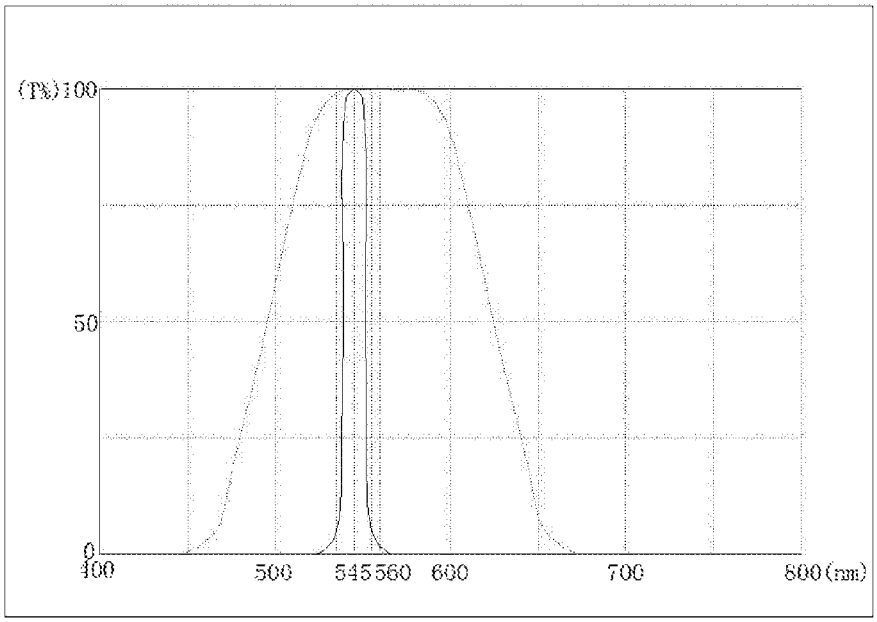
FIG. 4 is a graph of the wavelength of a filter plated with a narrow-band interference filter film disposed in front of the LED, and the wavelength of light emitted from the filter plate is 545±8 nm.

Refer to FIG. 2, this figure shows a graph of a wavelength of the light emitted directly from the LED chip in the related art (without filter), and the light band of the emitted light is 560±80 nm, and FIG. 3 is a graph of the wavelength when the narrow-band interference filter film is plated on the filter, and the transmitted light waveband is 545±8 nm, and the other wavebands cannot be transmitted, and FIG. 4 is a graph showing the wavelength of the superimposed two light waves generated after the filter 2 is disposed near the LED chip, obviously, the wavelength range of the light emitted from the filter 2 is 545±8 nm, this 545±8 nm band will be incident on the cemented lens (lens), the wavelength range of the incident light will be narrowed, and the monochromaticity will be improved and ensured, at the same time, because of the effect of the filter, the light energy of non-central wavelength light incident on the lens is reduced or filtered, thereby reducing the light energy emitted after the lens 3, thereby avoiding being easily discovered by outsiders and improving the concealment of the sight.

Without filter 2, the light of the 560±80 nm wavelength band emitted by the LED chip is incident on the cemented lens (lens), the wavelength range is wider, and the monochromaticity is reduced, since the light energy emitted from the lens is not filtered by more optical components, the spectrum of the emitted light is wider and the energy is stronger, and it is easy to be found by people looking from the direction B shown in FIG. 1, reducing the concealment.

Figure 5:
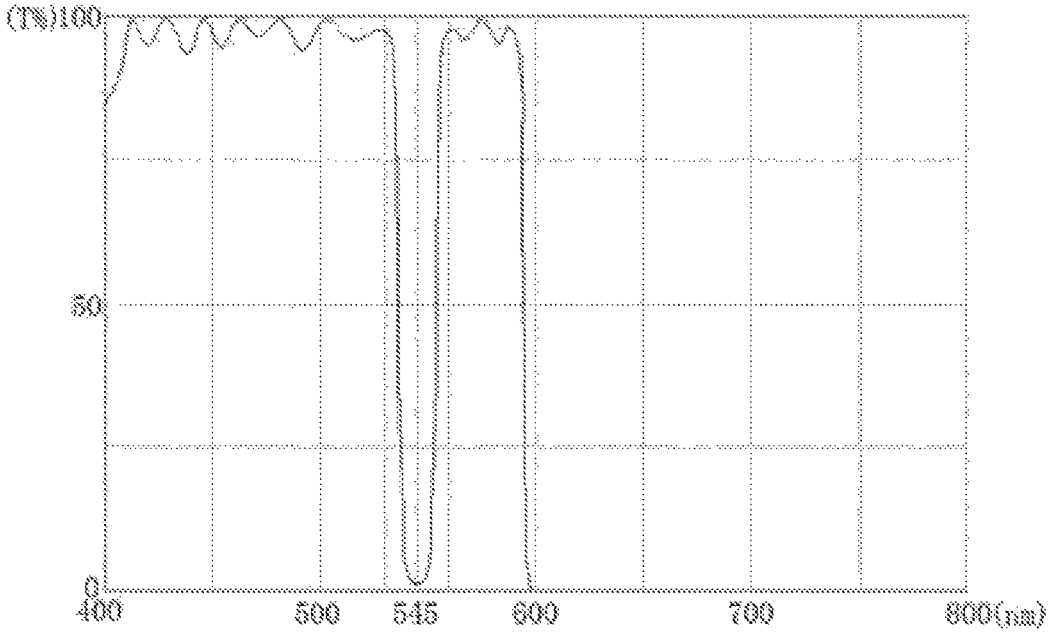
FIG. 5 is a graph of wavelength of the light passing through the cemented lens, the negative lens in the cemented lens is plated with a narrow-band interference filter film with a center wavelength of 545±15 nm and a long-wavelength cutoff filter film with a wavelength greater than 600 nm.

FIG. 5 shows a graph of wavelength of the light passing through the cemented lens, the negative lens is in the cemented lens plated with a narrow-band interference filter film with a center wavelength of 545±15 nm and a long-wavelength cutoff filter film with a wavelength greater than 600 nm.

Figure 6:
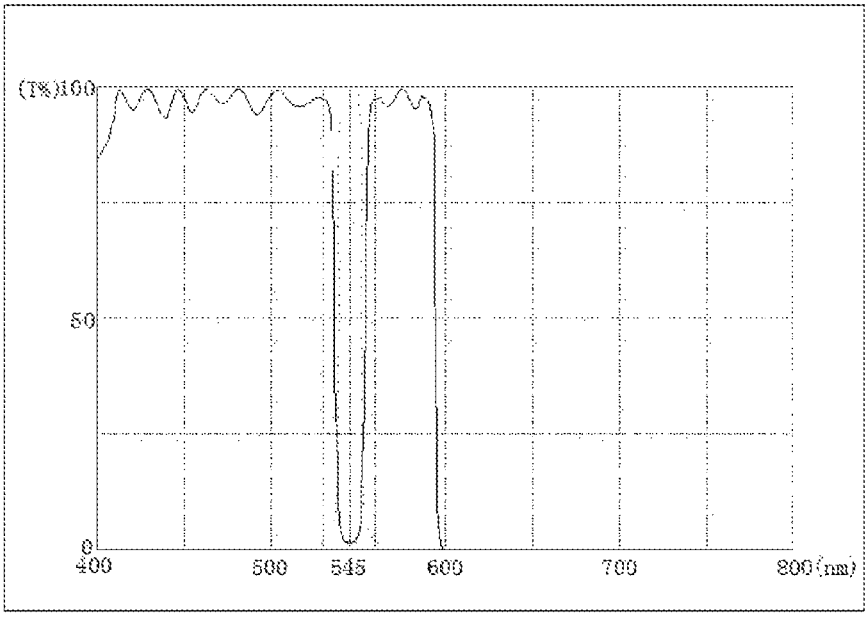
FIG. 6 is a graph of the superimposed wavelength of the light emitted from the filter and the light emitted from the cemented lens.

FIG. 6 shows the superposition of the light emitted from the filter and the light emitted from the lens, it can be seen from this figure that the narrow band of green light of 545±8 nm is reflected by the lens into the human eye, and the human eye only sees a green target image, which improves the monochromaticity. Viewing from the direction B, the light waves in the 560±80 nm wavelength band emitted by the LED are not emitted from the lens, which improves the concealment of the sight.

It should be particularly noted that the wavelength range involved in the present disclosure is not limited to the above example wavelengths, and may also be other wavelengths.

Figure 7:
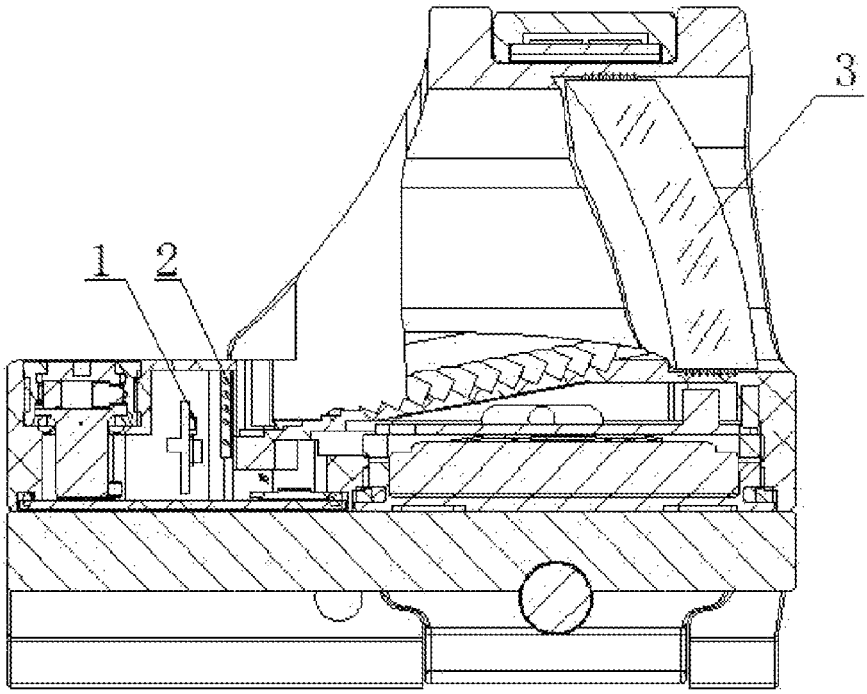
FIG. 7 is a schematic diagram of a sight of a specific application example.
Figure 8:
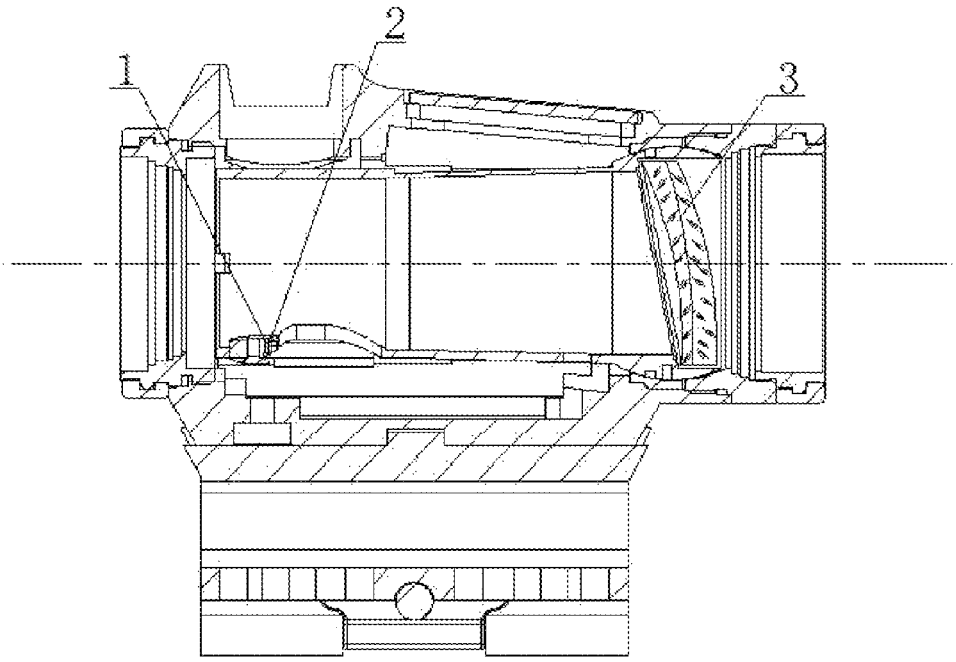
FIG. 8 is a schematic diagram of a sight of another specific application example.
Figure 9:
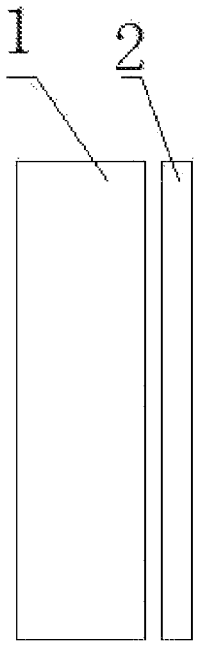
FIG. 9 is a schematic diagram showing a filter disposed near the light outlet hole of the LED chip in FIG. 7.

In order to understand the above embodiments more intuitively and better, this embodiment provides two different sights as shown in FIGS. 7 and 8. This figures clearly show that the filter 2 is installed near the LED chip 1 or at the light exit hole (see FIG. 9) in the direction of the light path to achieve the first filtering of the wavelength of the light emitted by the LED chip 1, filter out too wide and useless wavelength band light, thereby improving the monochromaticity and light energy control, the light filtered by the filter 2 is incident on the lens 3, and then reflected again and enters the human eye, that is, side A shown in FIG. 1. Due to the double filtering of the filter 2 and the lens 3, the light energy passing through the lens 3 is effectively reduced, thereby avoiding the perception of people at B shown in FIG. 1, thereby enhancing the concealment of the sight.

Figure 10:
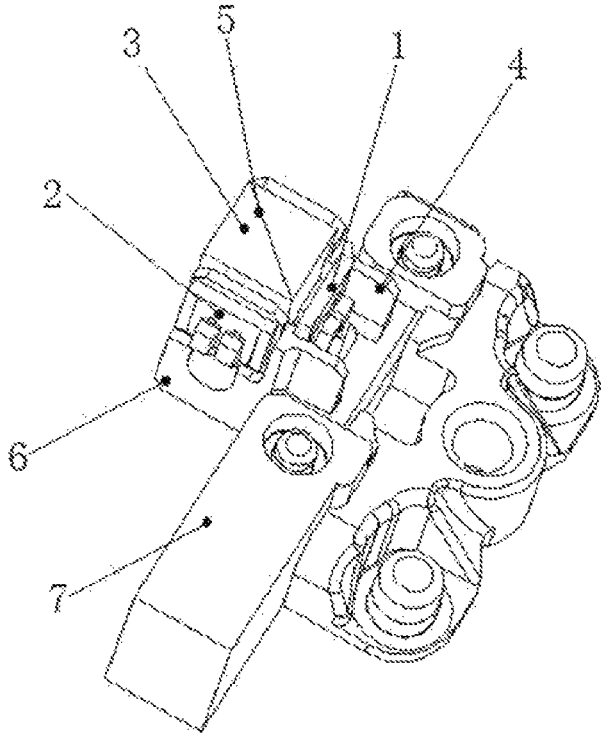
FIG. 10 is a schematic diagram of a two-light three-color optical system.
Figure 11:
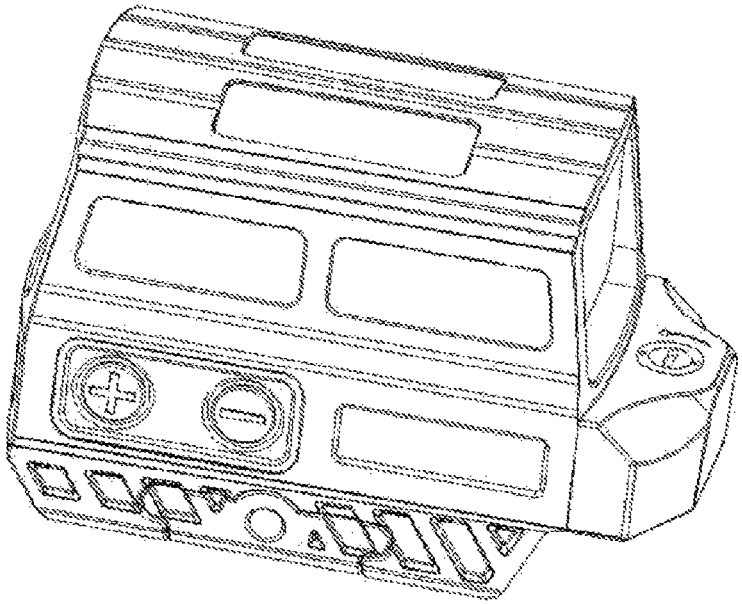
FIG. 11 is a perspective view of a sight with a two-light three-color optical system.

In order to overcome the problems of complex structure, large weight and volume of the existing multi-beam sights and the cost is high and inportability, this embodiment provides a two-light three-color optical system shown in FIG. 10, which includes a green light chip module 4, a red light chip module 5, and a cube prism 6; the green light chip module 4 and the red light chip module 5 are arranged perpendicular to each other, and they are independent of each other, through controlling the circuit, the emitted green light or red light can be shared, in order to generate the third color light, in this embodiment, the geometric center of the cube prism 6 is arranged at the intersection of the light emitted from the green light chip module 4 and the red light chip module 5, and the diagonal surface 8 of the cube prism 6 extending along the angle bisector of the angle between the light emitted from green light chip module 4 and the red light chip module 5 is plated with a composite film, the composite film is used to totally reflect the emitted red light of the red light chip module 5 and transmit the emitted green light of the green light chip module 4, (It is not difficult to see that the composite film is composed of red light total reflection and green light antireflection film, this is a general existing technology and will not be introduced too much) In this way, it is realized that the emitted light of red light is totally reflected by 90° and is parallel to the emitted light of green light, and all exit from the eyepiece of the sight shown in FIG. 11.

Figure 13:
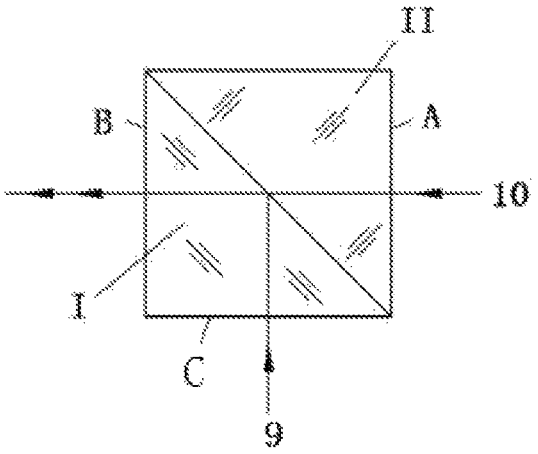
FIG. 13 is a schematic diagram of the running of the optical path of the cube prism.

As shown in FIG. 13, the incident surface A of the cube prism 6 perpendicular to the emitted light of the green chip module is plated with a narrow-band transmission film that transmits light with a wavelength of 545 nm to ensure that the required wavelength range of green light is emitted through the cube prism 6 without loss. The incident surface C and the exit surface B (the side opposite to the incident surface A is the exit surface B) perpendicular to the emitted red light of the red light chip module 5 are coated with a broadband anti-reflection coating to ensure that the red light and green light are emitted through the cube prism 6 without loss.

Figure 12:
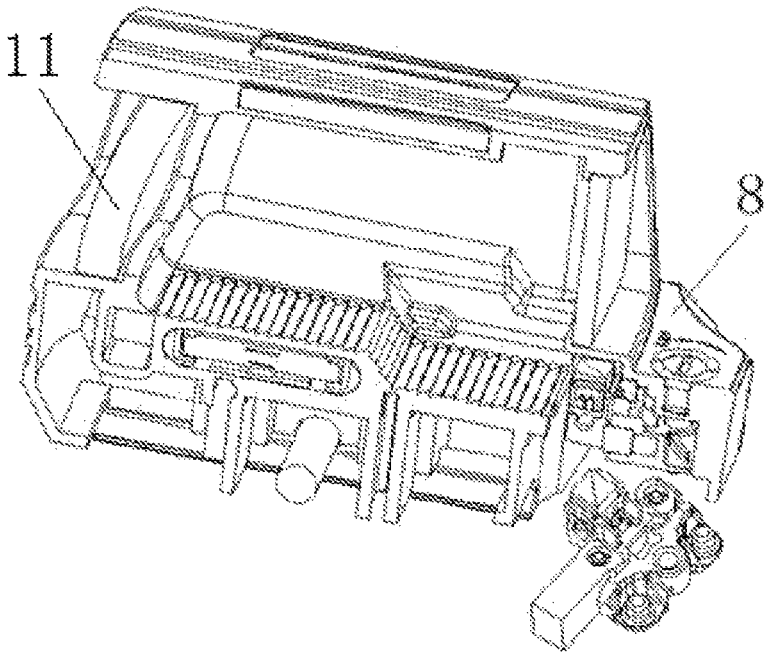
FIG. 12 is an axial cross-sectional view of a sight with a two-light three-color optical system.

In order to generate the third color light, this embodiment provides the sight shown in FIGS. 11 and 12, which is installed on the LED mounting base 7 at the rear end of the body 11, the green light chip module 4 is installed on the front end surface of the LED mounting base 7, and the red light chip module 5 is installed on the front end side of the LED mounting base 7 through an LED base 9; the installation plane of the LED base 9 is perpendicular to the front end surface of the LED mounting base 7. This ensures that the red light and the green light overlap each other to produce the third color light.

So far, it has been realized to generate multiple colored lights with the least light source, thereby reducing the complexity and maintenance cost of the sight.

Referring to FIG. 13, the cube prism 6 involved in the above described embodiment is formed by gluing two isosceles right-angle prisms (including isosceles right-angle prism I and isosceles right-angle prism II), the diagonal surface 8 is the cemented surface, the surfaces B and C of the cube prism 6 are both plated with a broad-band anti-reflection film with a wavelength of 400 to 800 nm; where, the adjacent surface A, which is perpendicular to the surface C, is plated with a narrow-band transmission film that transmits light with a wavelength of 545 nm. Surface A and surface C are the light incident surfaces of the green light chip module 4 and the red light chip module 5 respectively; the surface B is the light exit surface, after the light emitted from the green light chip module 4 and the red light chip module 5 passing through the diagonal surface 8, that is, the cemented surface, the light exit from the surface B.

Figure 14:
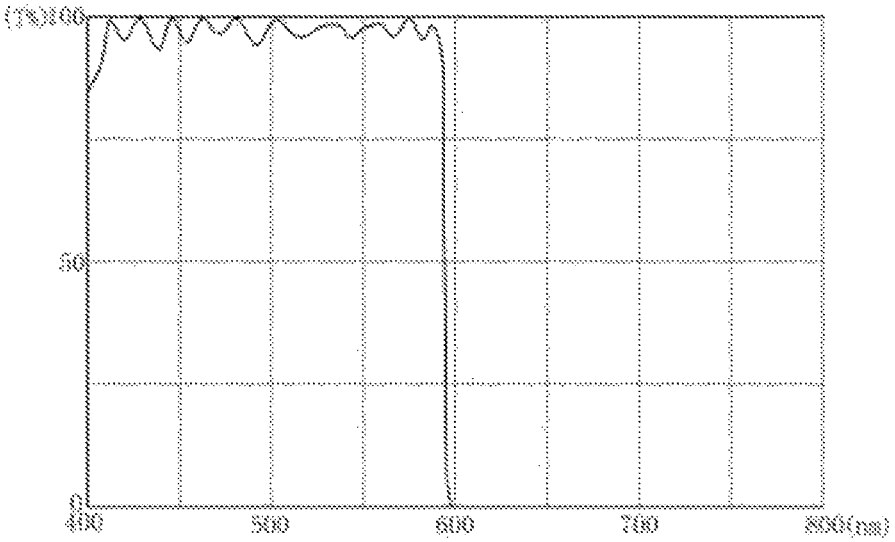
FIG. 14 is a graph of light rays with reflected wavelengths greater than 600 nm.

The specific light path is: the cube prism 6 is glued together by a isosceles right-angle prism I and a isosceles right-angle prism II, the light source 12, that is, the red light chip module 5 emits light with a center wavelength of $\lambda 0$=658 nm, this light is incident from the surface C of the isosceles right-angle prism I, reflected by the cemented surface of the isosceles right-angle prisms I and II, and then emitted from the surface B of the isosceles right-angle prism I, the direction of the light changes by 90°, The cemented surface is plated with a film that reflects light greater than 600 nm as shown in FIG. 14.

Figure 15:
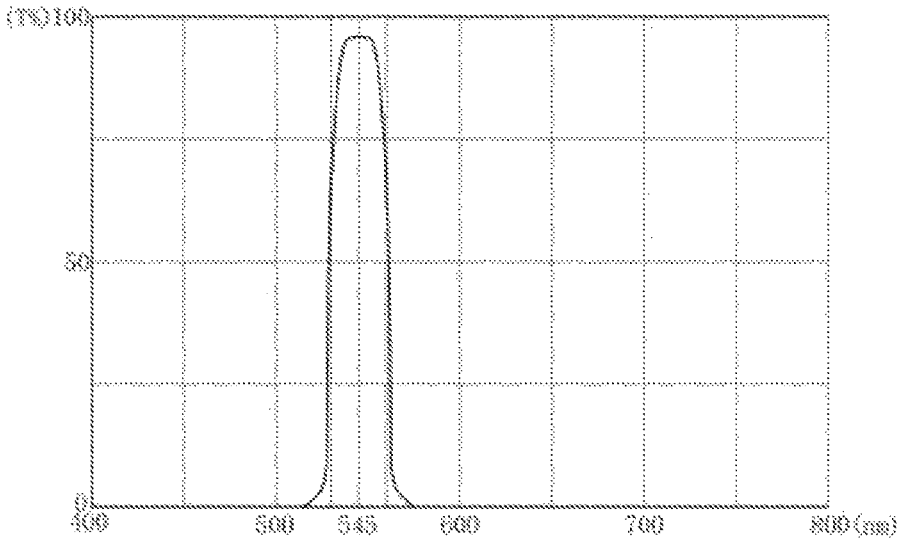
FIG. 15 is a graph of a narrow-band of light passing through a wavelength of 545 nm.
Figure 16:
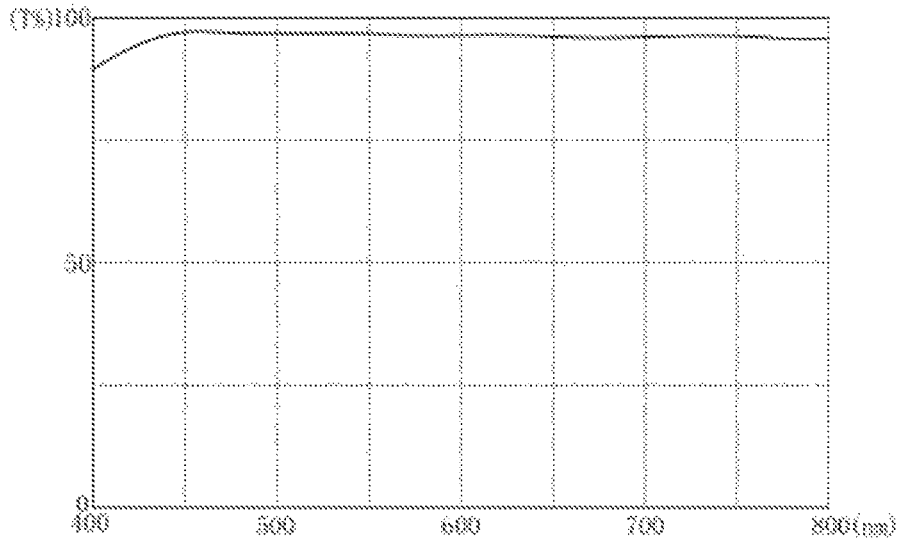
FIG. 16 is a graph of light of the transmittance of a broad-band anti-reflection film with a wavelength of 400 nm to 800 nm.

The light source 13 that is the green light chip module 4 emits light with a center wavelength of $\lambda 0$=545 nm, this light is incident from the surface A of the isosceles right-angle prism II, which is plated with a narrow-band transmission film that can transmit 545 nm±15 nm wavelength as shown in FIG. 15, this light is emitted from the surface B of the isosceles right-angle prism I after passing through the cemented surface of the isosceles right-angle prisms I and II, namely the diagonal surface 8. In addition, the surfaces A and B of the isosceles right-angle prism I are plated with a broad-band anti-reflection film with a wavelength of 400 to 800 nm as shown in FIG. 16.

Figure 17:
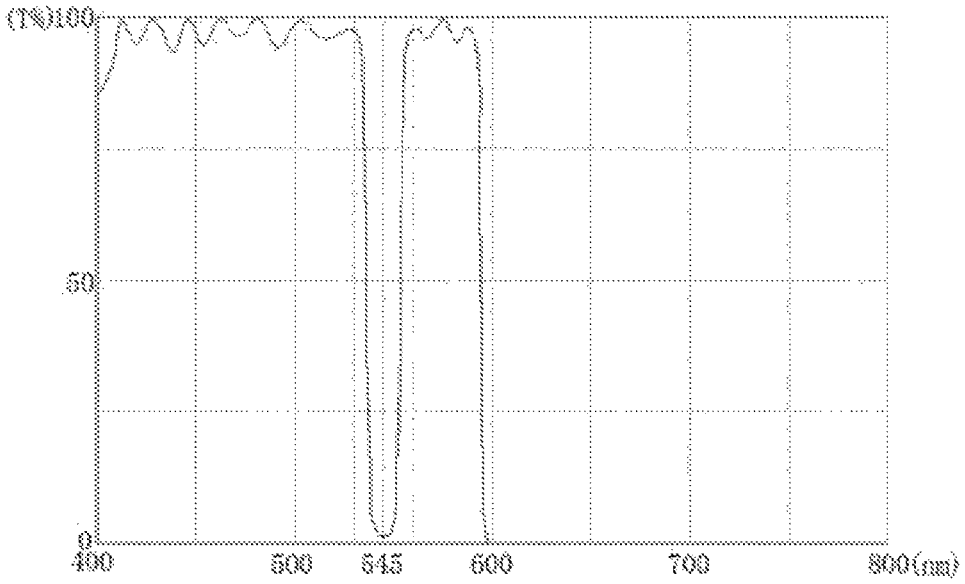
FIG. 17 is a graph of wavelength of the light passing through the cemented lens, the negative lens in the cemented lens is plated with a narrow-band filter film with a center wavelength of 545±15 nm and a long-wavelength cut-off filter film with a wavelength greater than 600 nm.

In the above described embodiment, the cemented lens 14 is composed of positive and negative lens, the positive and negative lens are arranged in the order of distance from the cube prism 6 from far to near; the negative lens is plated with a narrow-band interference filter film with a center wavelength of 545±15 nm and a long-wavelength cutoff filter film with a wavelength greater than 600 nm. Therefore, when the light emitted by the red and green light chip modules is incident on the reflective surface of the cemented lens 14, that is, the negative lens. The negative lens is plated with a narrow-band interference filter film and a long-wavelength cutoff filter film as shown in the graph of the FIG. 17. In this way, the light of the corresponding wavelength is reflected back to the eyepiece along the observation direction of the human eye, and the green light pattern or the red light pattern can be observed, and a yellow pattern composed of red and green light can also be observed, suitable for use in different aiming background environments.

What is claimed is:

1. A reflective inner red dot sight optical system with improved monochromaticity and concealment, comprising an LED chip and a lens for reflecting light emitted from the LED chip, wherein the LED chip is a green light chip, and wherein a filter plated with a narrow-band interference filter film is provided near the LED chip and located between the LED chip and the lens; the filter is used to filter out light of a wider waveband except the center wavelength emitted from the LED chip, which improves a monochromaticity of light entering a human eye, light energy of the light except the center wavelength emitted from the filter is weakened or cut off, light energy of the center wavelength emitted from the filter shines on a cemented surface of the lens, the cemented surface is plated with a cutoff film that cuts off the center wavelength.

2. The sight optical system according to claim 1, wherein a distance between the LED chip and the filter is 0 to 10 mm.

3. The sight optical system according to claim 2, wherein the distance between the LED chip and the filter is 0 to 4 mm.

4. The sight optical system according to claim 2, wherein the distance between the LED chip and the filter is any one of 2 mm, 1.5 mm, 1 mm, 0.5 mm and 0.2 mm.

5. A two-light three-color optical system, wherein the optical system comprises: a green light chip module, a red light chip module, a cube prism and a cemented lens; the green light chip module and the red light chip module are arranged perpendicular to each other, a geometric center of the cube prism is arranged at an intersection of light emitted from the green light chip module and the red light chip module; the cemented lens is arranged on the exit light path of the cubic prism; the cemented lens is composed of a positive lens and a negative lens, the positive lens and the negative lens are arranged in the order of distance from the cube prism from far to near; the negative lens is plated with a narrow-band interference filter film with a center wavelength of 545±15 nm and a long-wavelength cutoff filter film with a wavelength greater than 600 nm; a diagonal surface of the cube prism extending along an angle bisector of an angle between light emitted from green light chip module and the red light chip module is plated with a composite film, the composite film is used to totally reflect an emitted red light of the red light chip module and transmit an emitted green light of the green light chip module.

6. The two-light three-color optical system according to claim 5, wherein the cube prism is formed by gluing two isosceles right-angle prisms, the diagonal surface is a cemented surface; the surface A, surface B, and surface C of the cube prism are all plated with an anti-reflection film with different wavelength of the light;

the surface A and the surface B are two adjacent surfaces that are perpendicular to each other, and are respectively light incident surfaces of the green light chip module and the red light chip module;

the surface B is a light exit surface after the light emitted by the green light chip module and the red light chip module passes through the diagonal surface.

7. A sight including the two-light three-color optical system according to claim 5, comprising: an LED mounting base installed at the back of a body, wherein the green light chip module is installed on a front end surface of the LED mounting base, and the red light chip module is installed on a front end side of the LED mounting base through an LED base; an installation plane of the LED base is perpendicular to the front end surface of the LED mounting base.

8. The sight optical system according to claim 3, wherein the distance between the LED chip and the filter is any one of 2 mm, 1.5 mm, 1 mm, 0.5 mm and 0.2 mm.

* * * * *